US005823103A

United States Patent [19]

Kuei

[11] Patent Number: 5,823,103

[45] Date of Patent: Oct. 20, 1998

[54] STRAP-FEEDING MECHANISM FOR AN AUTOMATIC STRAPPING MACHINE

[75] Inventor: Li Pi Kuei, Taipei Hsien, Taiwan

[73] Assignee: Gin Dah Enterprise Corp., Taipei, Taiwan

[21] Appl. No.: 865,908

[22] Filed: May 30, 1997

[51] Int. Cl.[6] ..... B65B 13/06

[52] U.S. Cl. ..... 100/4; 100/26; 100/32; 53/589

[58] Field of Search ..... 100/4, 26, 29, 100/32; 53/589

[56] References Cited

U.S. PATENT DOCUMENTS

| | | | |
|---|---|---|---|
| 4,559,767 | 12/1985 | Takami | 100/32 |
| 5,236,329 | 8/1993 | Sylvester | 100/32 |

FOREIGN PATENT DOCUMENTS

| | | | |
|---|---|---|---|
| 63-307008 | 12/1988 | Japan | 100/32 |
| 63-317405 | 12/1988 | Japan | 100/32 |
| 1-153414 | 6/1989 | Japan | 100/32 |
| 5-65124 | 3/1993 | Japan | 100/32 |
| 2059010 | 4/1981 | United Kingdom | 100/32 |

*Primary Examiner*—Stephen F. Gerrity
*Attorney, Agent, or Firm*—W. Wayne Liauh

[57] ABSTRACT

A strap-feeding mechanism for an automatic strapping machine including a quick strap-feeding mechanism for quickly feeding a strap into a strap rail on the automatic strapping machine and an automatic strap-refeeding mechanism for clamping a strap which slides off the strap rail during a pull-back operation, so that the strap is prevented from further sliding backward and is automatically refed into the strap rail again. The quick strap-feeding mechanism mainly includes a stationary panel and a cover panel. The stationary panel is provided with a strap guiding channel which has a lower end connected to a strap outlet of a strap-storing power unit, an upper end connected to a strap inlet of a strap-feeding unit, and a straight middle section having only one side wall. The cover panel is fixed to a front of the stationary panel and has a movable leaf which can be turned to extend into the stationary panel and forms another side wall of the straight middle section of the strap guiding channel. The strap refeeding mechanism includes a driving wheel and an opposite rotational wheel extending into the upper end of the strap guiding channel to together clamp the strap slidden off the strap rail and then refeed the strap into the strap rail.

3 Claims, 8 Drawing Sheets

STRAP-FEEDING MECHANISM FOR AN AUTOMATIC STRAPPING MACHINE

BACKGROUND OF THE INVENTION

In a strapping machine, there is a strap-feeding mechanism being driven to operate by a driving motor (which can rotate in forward and reverse directions alternately) to feed and pull backward a continuous strap for winding about and tightly strapping up something. To enable the strap to be fed and pulled backward smoothly, it is a common practice to provide a strap storage between a strap-feeding unit and a strap-storing power unit. The portion of a strap being pulled backward by the strap-feeding unit is temporarily stored in the strap storage. The strap-storing power unit shall timely rotate to guide the strap from a strap roll outside the strapping machine into the strapping machine. The strap being guided into the strapping machine is first stored in the strap storage in a zigzag form and is ready for the next feeding of strap.

FIG. 1 generally illustrates a strap-feeding mechanism in a conventional automatic strapping machine. To guide a beginning of the strap 11 into the strapping machine, a door covering the machine must be fully opened first, so as to completely expose an interior of a strap storage 15. Then, the strap 11 is pulled and guided with hands from a strap roll outside a machine housing 10 to pass a brake 12 and extend into the machine housing 10. With the help of a strap guiding roller 13, the strap 11 is further guided to an inlet of a strap-storing power unit 14. Thereafter, a push-button switch (not shown) of the strap-storing power unit 14 is pushed to cause rollers in the unit 14 to rotate at high speed and the strap 11 passing through the unit 14 is successfully guided into the strap storage 15. The beginning of the strap 11 is moved toward an opening 16 at a top of the strap storage 15 and is further manually pulled and guided into an inlet of a strap-feeding unit 17. A push-button switch (not shown) of the strap-feeding unit 17 is pushed to cause rollers in the strap-feeding unit 17 to rotate at high speed. The strap 11 passing through the strap-feeding rollers rotating at high speed is thereby directly guided into a strap rail 18 above the machine housing 10.

Following drawbacks and disadvantages are found in the guiding and feeding of the strap 11 with the above conventional strap-feeding mechanism in the automatic strapping machine:

1. The door covering the machine housing must be fully opened before the strap can be guided into the strapping machine. Therefore, a considerably large space is required to locate the machine. Otherwise, it is necessary to move the machine frequently to a spacious place for opening the door.
2. The strap 11 is manually guided and threaded through different parts in the strapping machine before it is fed into the strap rail 18. This is of course very troublesome and inconvenient. An operator must often bow or extend his body and hands into the machine housing to complete the guiding of the strap.
3. To successfully guide the strap 11 into the strap rail 18, the operator must insert the beginning of strap into the strap-feeding unit 17 and press to hold the strap 11 in place with a hand, lest the strap 11 should slide backward into the strap storage 15. However, since the opening 16 at the top of the strap storage 15 is small and a distance between the opening 16 and the inlet of the unit 17 is short, it is very possible that the operator's hand holding the strap 11 shall be dangerously brought to collide with the unit 17 when the switch of the strap-feeding unit 17 is pushed and the strap 11 is instantaneously moved forward at high speed.
4. The steps of feeding the strap in the conventional strap feeding mechanism are complicate and require a lot of time and labor, and the automatic strapping machine is therefore low efficient in its operation.

After a package is strapped on the automatic strapping machine, the strap 11 shall be automatically fed into the strap rail 18 for a next strapping. There are chances the strap 11 is not fed to a predetermined position for the next strapping during the procedure of automatic feeding of strap into the strap rail 18. In this case, the strap 11 will be completely pulled back into the strap storage 15 when the rollers in the strap-feeding unit 17 pull the strap 11 backward to tightly wind about the package to be strapped. At this point, the operator must expose the strap storage 15 to insert the beginning of the strap 11 into the strap-feeding unit 17 again, so that the strap 11 can be fed into the strap rail 18. This will of course bring a lot of troubles to the operator and waste a lot of time. Since the reason that results in such conditions might be a mechanical problem in the mechanism or a problem in the strap itself, it requires many times of trial and error to determine the real cause. The same movements of guiding and inserting the strap 11 shall be repeated after each trial. The operator will inevitably become impatient with this time-consuming work.

It is therefore tried by the inventor to develop a strap-feeding mechanism for an automatic strapping machine to eliminate the drawbacks existing in the conventional strap-feeding mechanism.

SUMMARY OF THE INVENTION

The strap feeding mechanism for an automatic strapping machine according to the present invention includes a quick strap-feeding mechanism and an automatic strap-refeeding mechanism. The quick strap-feeding mechanism can quickly and automatically feed the beginning of a strap into a strap rail of the automatic strapping machine. And, the automatic strap-refeeding mechanism can automatically refeed the strap when it slides off the strap rail.

The quick strap-feeding mechanism of the present invention mainly includes a stationary panel and a cover panel. The stationary panel is provided with a strap guiding channel. A lower end of the strap guiding channel is connected to an outlet of a strap-storing power unit in the strapping machine. An upper end of the strap guiding channel is connected to a strap inlet at a first end of a strap-feeding unit in the strapping machine. A vertical straight middle section of the strap guiding channel has only one side wall. The cover panel is assembled to the stationary panel to form a front cover of the stationary panel. A vertically extended movable leaf is fixed to the cover panel such that a front edge of the movable leaf does not project into the stationary panel when the vertical movable leaf is in its normal position. When the beginning of the strap is to be fed into the strap rail, a first electromagnetic thread rod is actuated to cause the front edge of the movable leaf to turn toward the stationary panel by 45 degrees, so that a front portion of the movable leaf forms another side wall of the vertical section of the strap guiding channel in the stationary panel.

A driving wheel driven by a small motor is provided at one side of a section of the strap guiding channel between the strap-feeding unit and a strap storage. The driving wheel is so located that a part of it extends into the strap guiding channel. An arm member driven by a second electromagnetic thread rod is provided at another side of the strap guiding channel opposite to the driving wheel. A rotatable wheel is pivotally connected to a free end of the arm member. When the second electromagnetic thread rod is actuated, it drives the arm member to turn into the strap guiding channel so that the rotatable wheel pivotally connected to the free end of the arm member contacts with and presses against the driving wheel in the strap guiding channel.

The strap-refeeding mechanism includes a strap-feeding unit which has an upper movable seat supporting rollers for feeding the strap forward. A press plate is provided on the movable seat near a second end of the strap-feeding unit opposite to the strap inlet at the first end of the strap-feeding unit. In the event the strap-feeding rollers pull the strap backward to tightly strap a package and the strap slides off the strap rail and even the strap-feeding unit, the strap-feeding roller that is mounted on the movable seat at the second end shall descend because there is no strap passing below it. The press plate provided on the movable seat shall descend at the same time to touch a microswitch below it, and the microswitch in turn immediately actuates the second electromagnetic thread rod, so that the arm member and the rotatable wheel connected thereto extend into the strap guiding channel to together with the driving wheel clamp the slidden strap. Then, the small motor is actuated to rotate the driving wheel and send the strap back into the strap-feeding unit, allowing the strap to be fed into the strap rail again by the strap-feeding rollers.

DETAILED DESCRIPTION OF THE PREFERRED EMBODIMENT

The present invention relates to a strap-feeding mechanism for an automatic strapping machine. The strap-feeding mechanism further includes a quick strap-feeding mechanism and a strap-refeeding mechanism.

Figure 1:
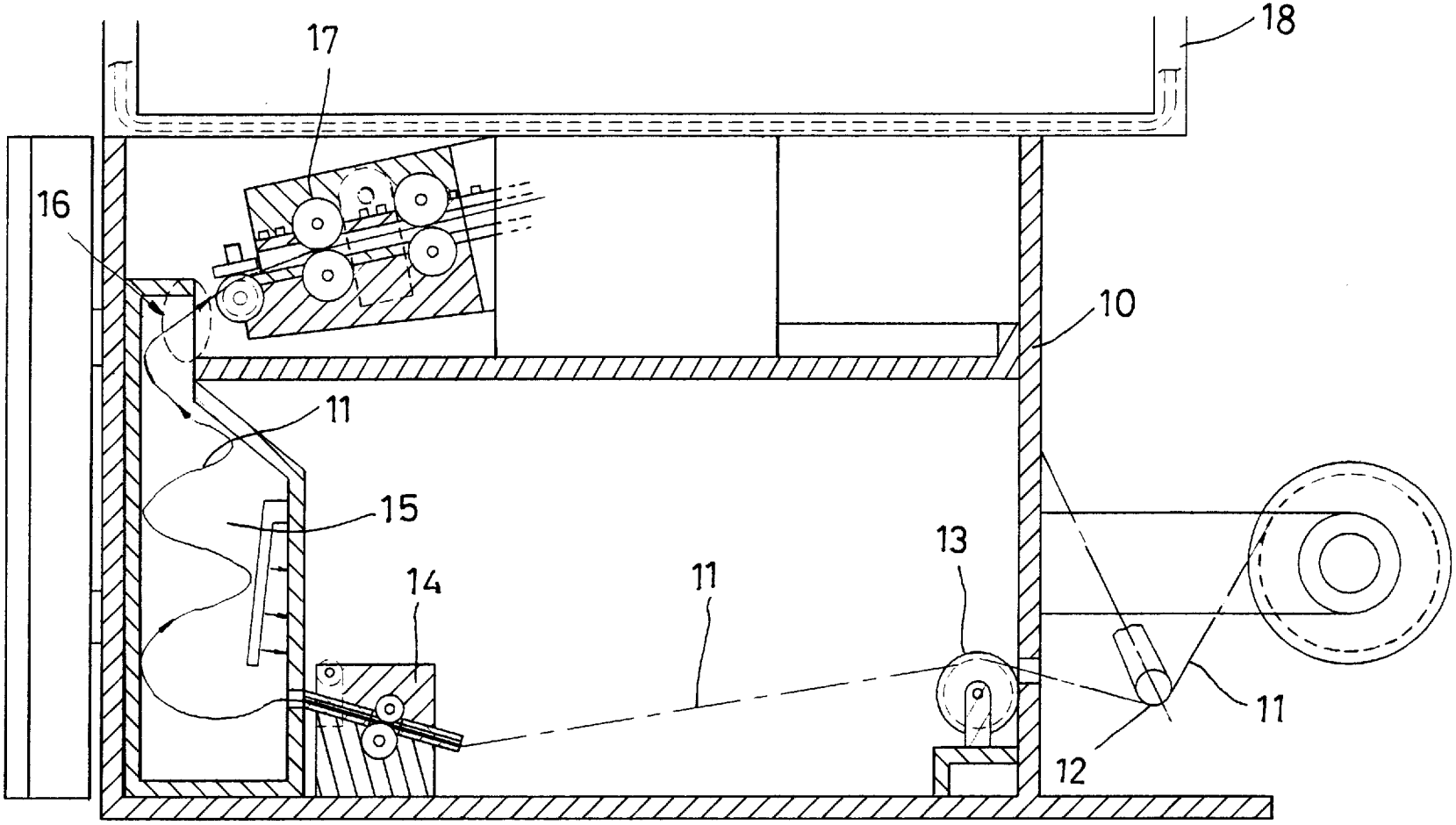
PRIOR ART FIG. 1
FIG. 1 illustrates the structure of a strap-feeding mechanism of a conventional automatic strapping machine.
Figure 2:
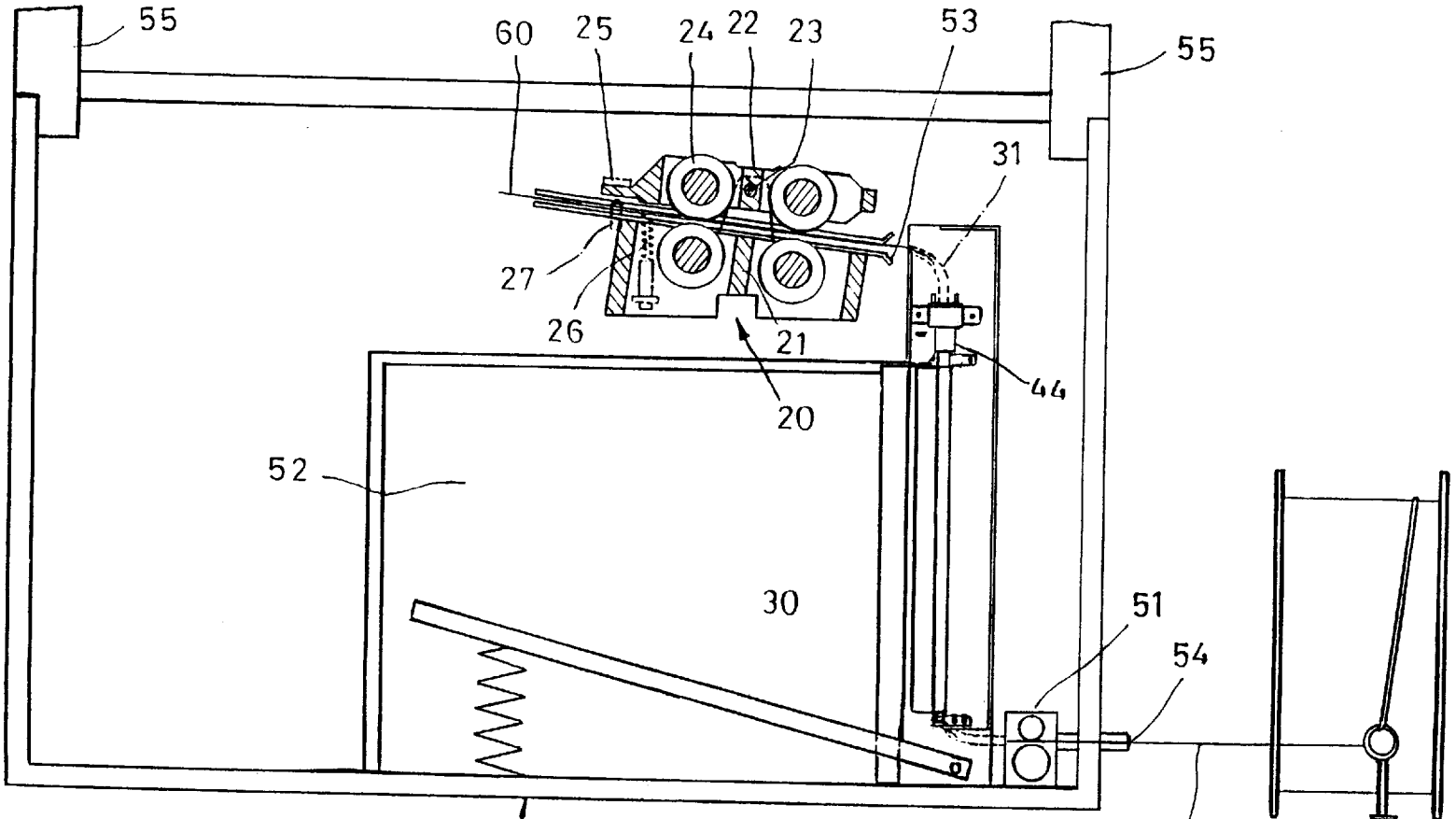
FIG. 2 illustrates the structure of a strap-feeding mechanism of an automatic strapping machine according to the present invention.

The quick strap-feeding mechanism of the present invention includes a stationary panel 30 and a cover panel 40 and is installed within the automatic strapping machine 50, as shown in FIG. 2.

Figure 3:
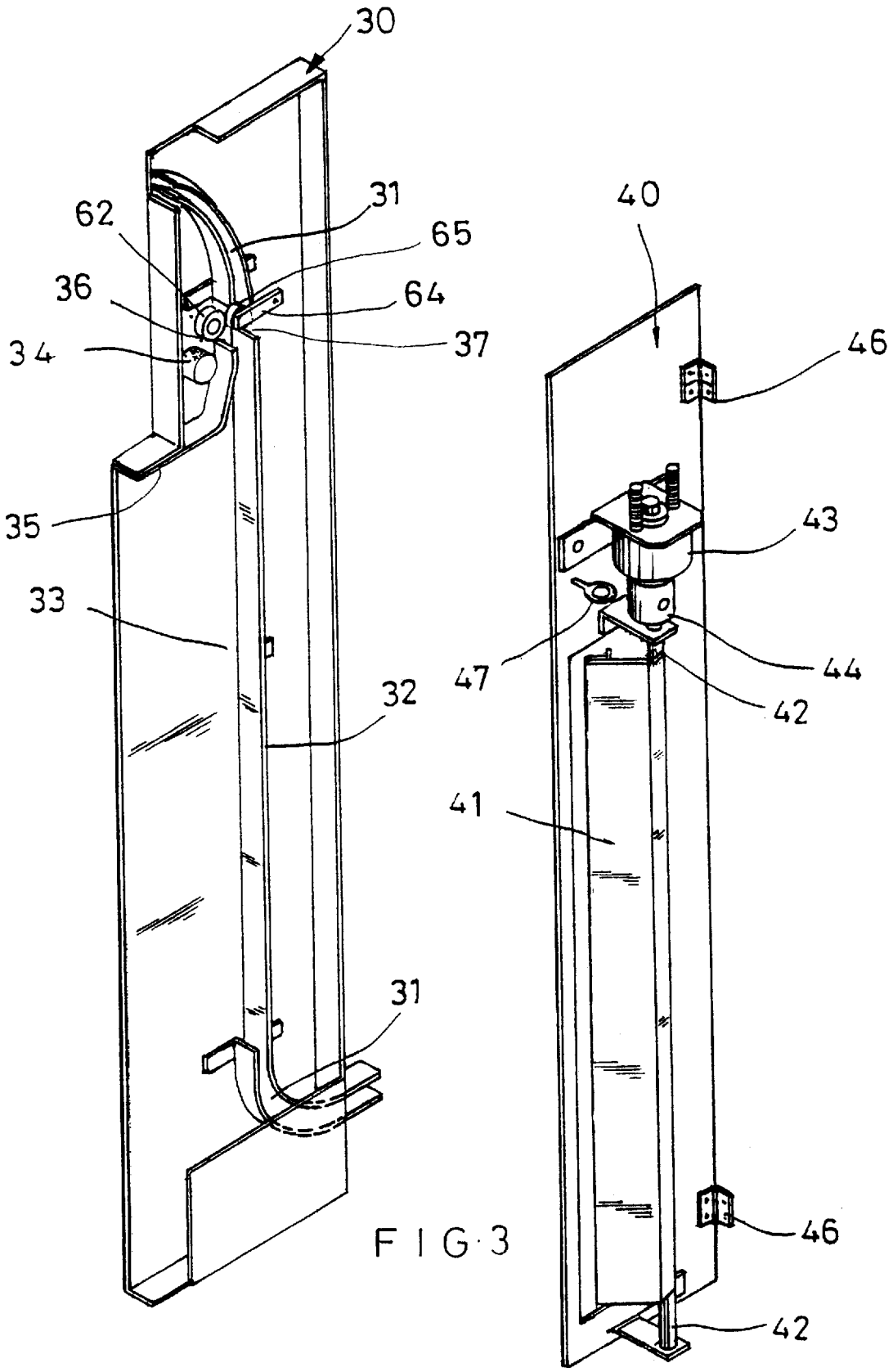
FIG. 3 is a disassembled perspective of the stationary panel and the cover panel together forming the quick strap-feeding mechanism of the present invention.
Figure 4:
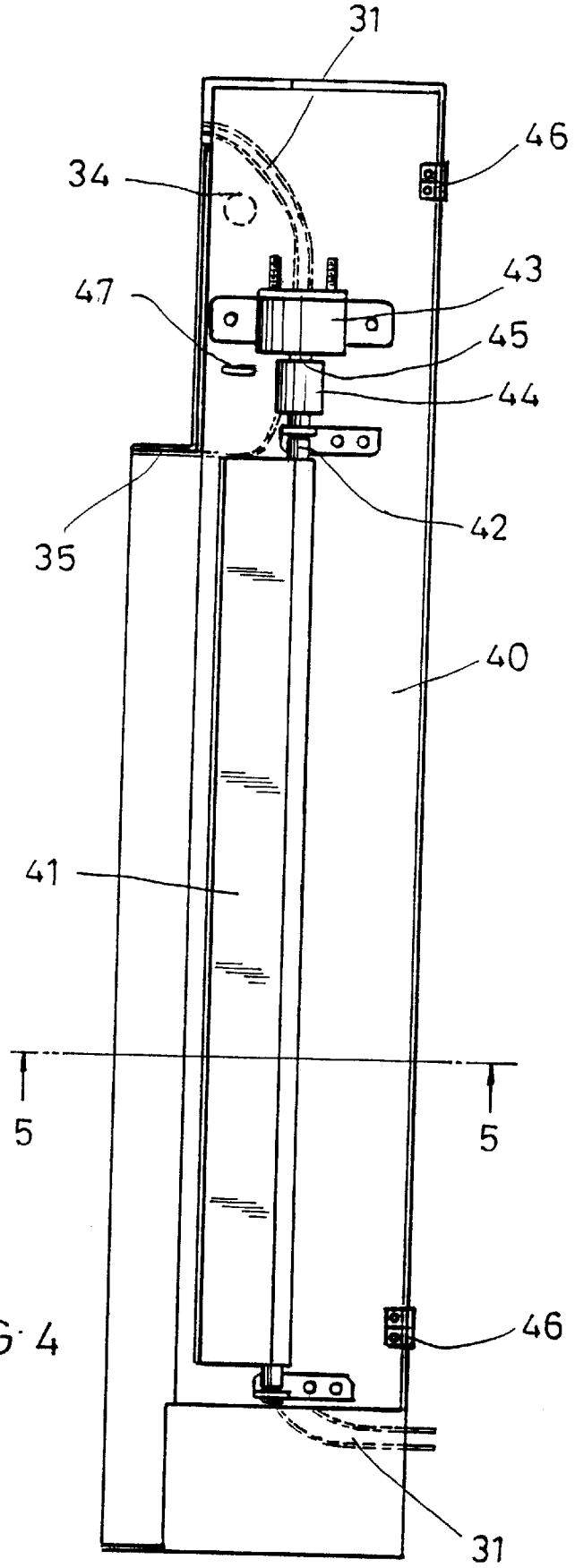
FIG. 4 is a front elevational view of the assembled stationary panel and cover panel.

Please refer to FIGS. 2, 3 and 4 at the same time. The stationary panel 30 is provided with a strap guiding channel 31 for guiding a strap 60 to move forward. The guiding channel 31 has a lower end which is connected to a strap outlet of a strap-storing power unit 51 in the automatic strapping machine 50 and an upper end which is connected to a strap inlet 53 of a strap-feeding unit 20 in the strapping machine 50. A vertical straight middle section of the strap guiding channel 31 has only a right side wall 32 (when viewing from a front of the drawings) forward projecting from a front surface of the stationary panel 30. A left side of the strap guiding channel 31 forms a vertical opening 33.

The cover panel 40 is assembled to a front side of the stationary panel 30. A vertically extended movable leaf 41 is fixedly mounted on a vertical shaft 42 which can be driven by a first electromagnetic thread rod 43 to turn 45 degrees, bringing the leaf 41 from a normal position to a projected position. Please refer to FIG. 5, when the leaf 41 is in its normal position, a front edge thereof opposite to the shaft 42 does not project from the cover panel 40 into the stationary panel 30. Please refer to FIG. 6, when the first electromagnetic thread rod 43 is actuated, the leaf 41 is turned along with the shaft 42 by 45 degrees to extend into the stationary panel 30, forming a left side wall of the vertical straight middle section of the guiding channel 31. At this point, the strap 60 can be guided in the guiding channel 31 having complete right and left side walls to the strap-feeding unit 20.

Figure 7:
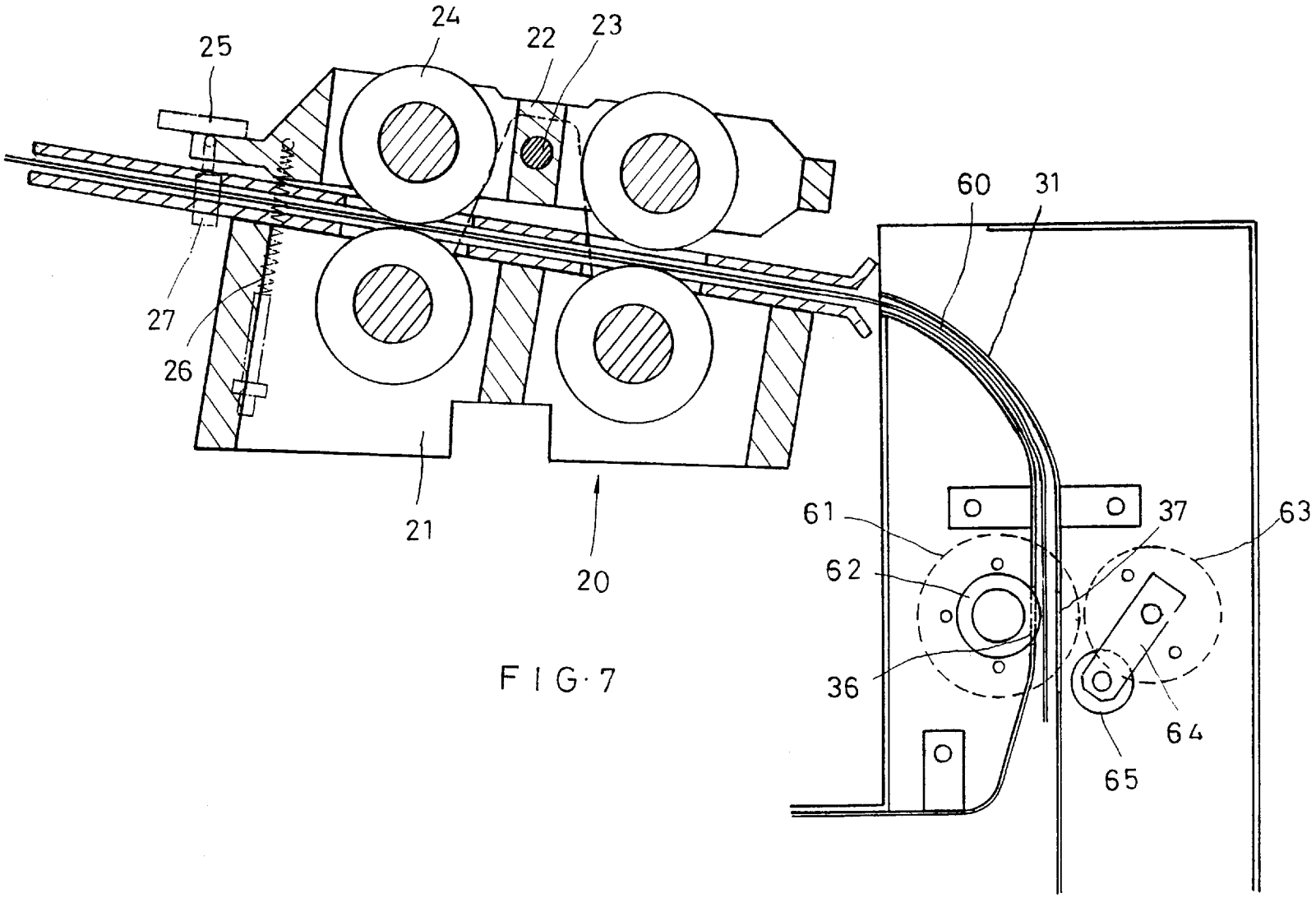
FIG. 7 is a fragmentary front view particularly showing a top portion of the stationary panel.

Please refer to FIGS. 3 and 7. A small motor 61 is provided to a top left side of the guiding channel 31 to rotate a driving wheel 62 which has a part extends into the guiding channel 31 via a cut 36 formed on a top left side wall of the guiding channel 31. A second electromagnetic thread rod 63 is provided to a top right side of the guiding channel 31 to turn an arm member 64. A rotatable wheel 65 is pivotally connected to a free end of the arm member 64. When the second electromagnetic thread rod 63 is actuated to turn the arm member 64, the rotatable wheel 65 moves along with the arm member 64 and extends a part of it into the guiding channel 31 via a cut 37 formed on the right side wall 32 to contact with and press against the driving wheel 62.

Figure 8:
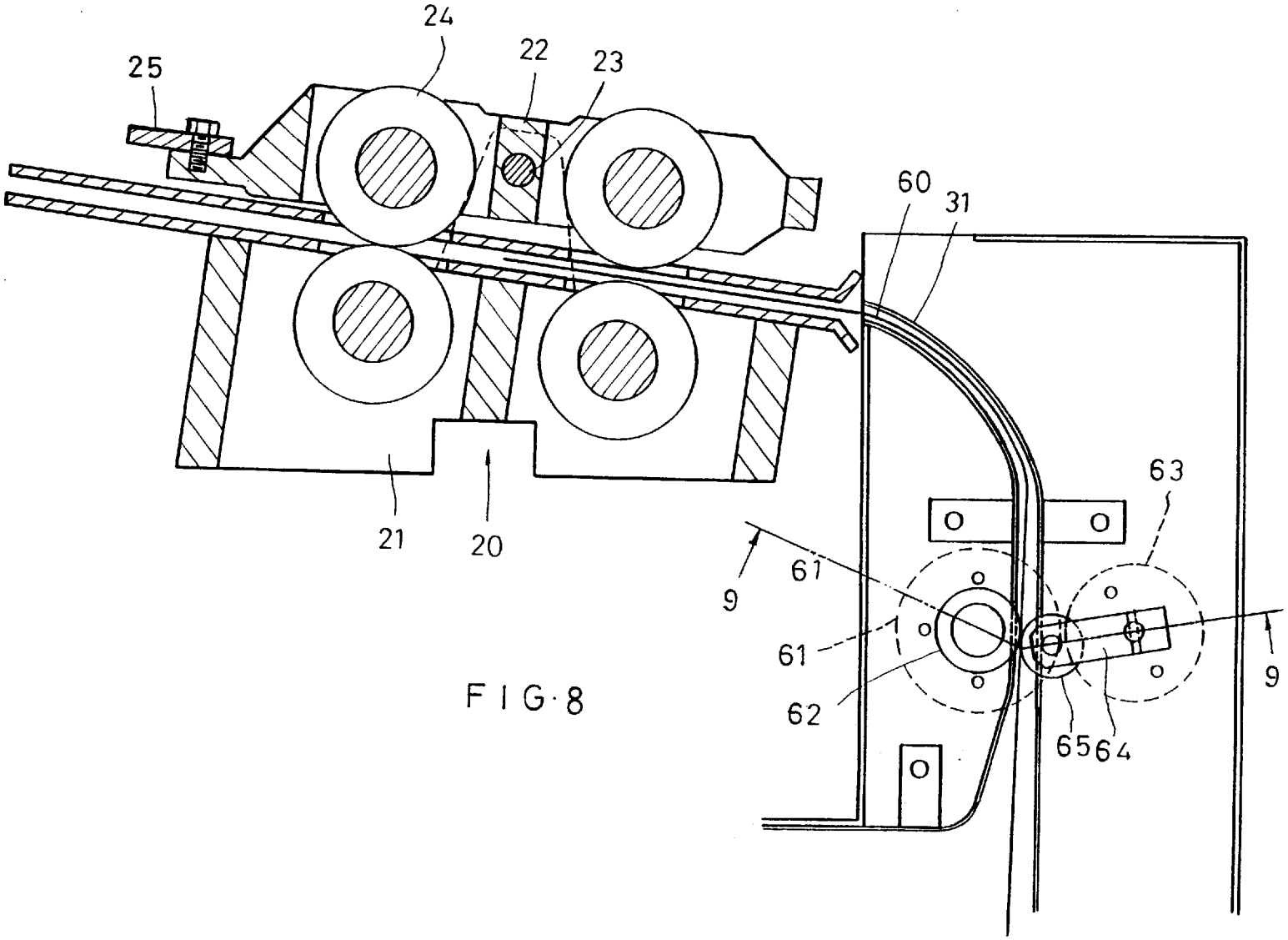
FIG. 8 illustrates the manner in which a slidden strap is refed by the present invention.
Figure 9:
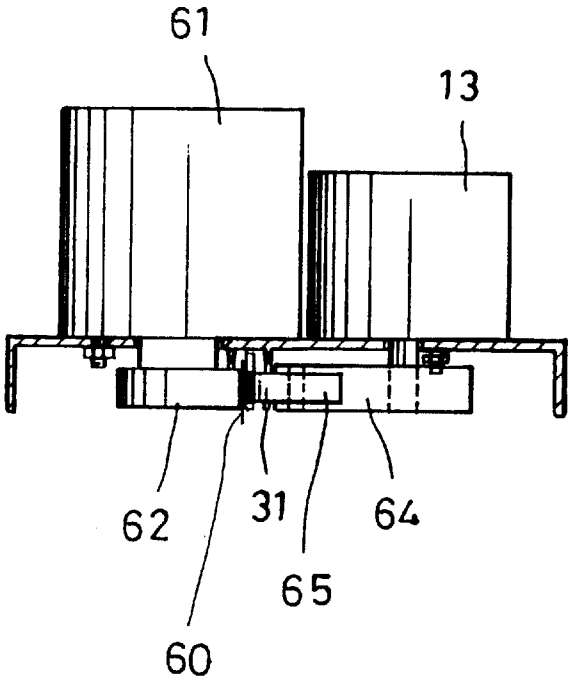
FIG. 9 is a sectional view taken on line 9—9 of FIG. 8.
Figure 10:
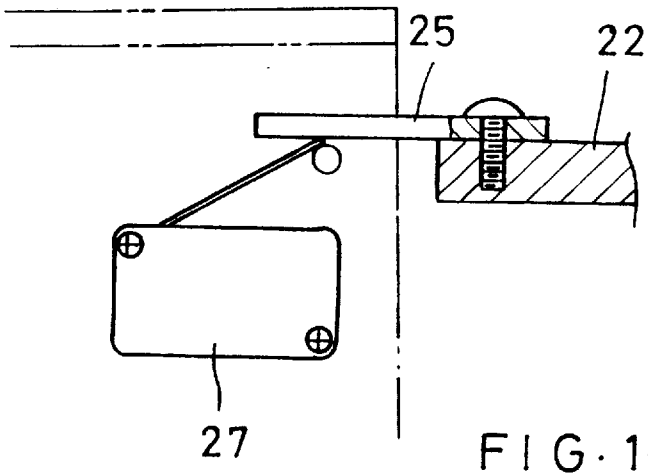
FIG. 10 is a fragmentary side view showing the microswitch in an non-actuated state.
Figure 11:
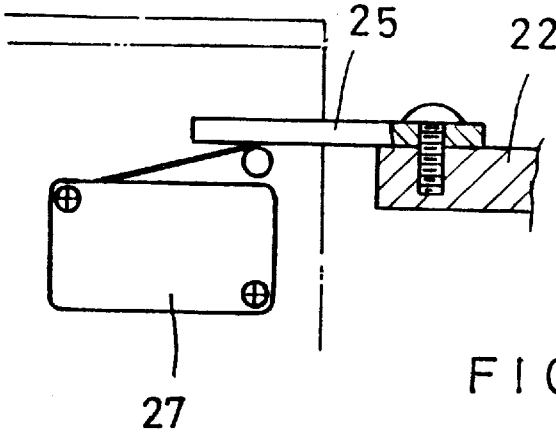
FIG. 11 is similar to FIG. 10 but with the microswitch in an actuated state.

Please refer to FIG. 7. The strap-feeding unit 20 has a lower fixed seat 21 and a top movable seat 22 above the fixed seat 21. The movable seat 22 can slightly swing up and down about a pivotal center 23 thereof. A damping spring 26 is connected to a left end of the movable seat 22 to normally pull the left end of the movable seat 22 downward. Since this is a prior art, it is not described in details herein. What is to be noted is a press plate 25 is provided at a leftmost end of the movable seat 22. When rollers of the strap-feeding unit 20 pull the strap 60 backward to tighten the strap 60 around a package and the strap 60 unexpectedly slides off a strap rail 55 and the strap-feeding unit 20 of the automatic strapping machine 50, a strap-feeding roller 24 supported at the left end of the movable seat 22 shall descend a little, as shown in FIG. 8, because there is no strap 60 passing below the roller 24. This causes the press plate 25 at the leftmost end of the movable seat 22 to descend and press down a microswitch 27 below the press plate 25, as shown in FIGS. 10 and 11. At this point, the second electromagnetic thread rod 63 is actuated to drive the arm member 64 to turn a predetermined angle, bringing the rotatable wheel 65 at the free end of the arm member 64 to together with the driving wheel 62 clamp the retracted strap 60 and prevent the strap 60 from sliding backward any further. When the automatic strapping machine 50 completes a second time strapping movements (which is a preset operation in the automatic strapping machine), the small motor 61 is actuated to drive the driving wheel 62 to rotate, so that the strap 60 clamped between the driving wheel 62 and the rotatable wheel 65 is moved forward and fed into the strap rail 55 again.

Figure 5:
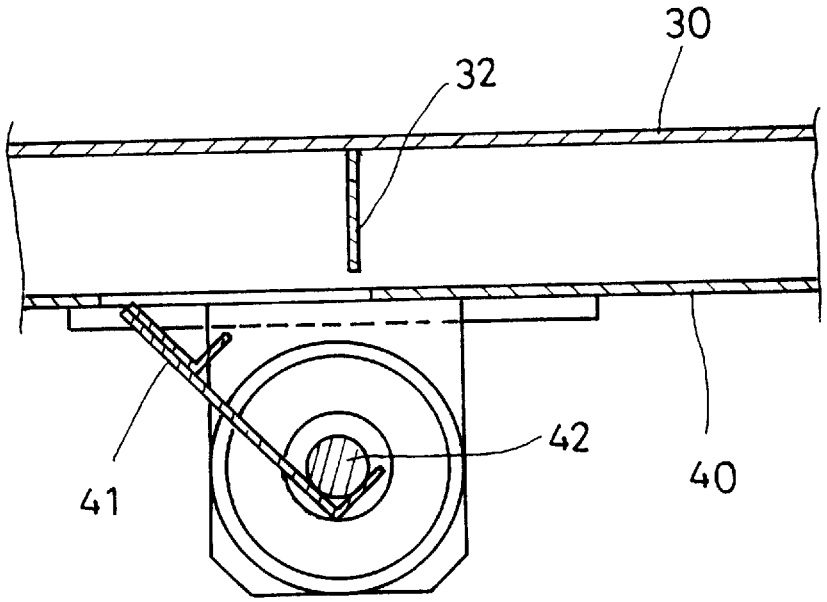
FIG. 5 is a sectional view of the assembled stationary panel and cover panel taken on line 5—5 of FIG. 4.
Figure 6:
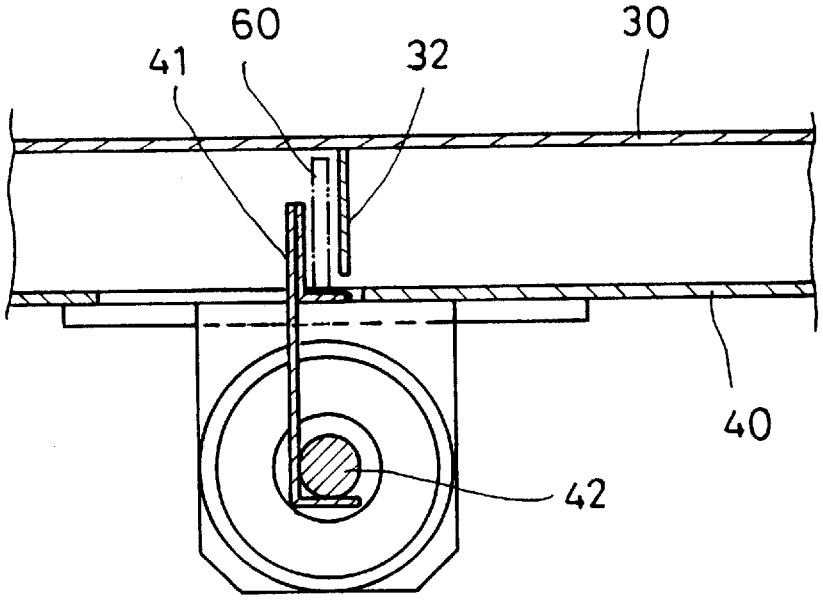
FIG. 6 is a sectional view of the assembled stationary panel and cover panel taken on line 5—5 of FIG. 4 but with the movable leaf of the cover panel forming a side wall of the strap guiding channel in the stationary panel.

To send the beginning of the strap into the automatic strapping machine 50, first actuates the first electromagnetic thread rod 43 so that the movable leaf 41 is turned by 45 degrees to become perpendicular to the stationary panel 30, as shown in FIG. 6, and forms the left side wall for the vertical straight middle section of the strap guiding channel 31 on the stationary panel 30. Then, draw the strap 60 to extend it into the automatic strapping machine 50 via an insertion opening 54 formed on an outer wall of the machine 50, so that the strap 60 enters the strap-storing power unit 51. At this point, a strap-storing motor (which is a known element and is not shown in the drawing) in the strap-storing power unit 51, the small motor 61, and the second electromagnetic thread rod 63 are actuated at the same time to send the strap 60 to the strap-feeding unit 20. Due to the strap 60 which passes between rollers of the strap-feeding unit 20, the left end of the movable seat 22 is caused to ascend. This means the micro-switch below the leftmost end of the movable seat 22 is not in a contacted and pressed state and the small motor 61 and the second electromagnetic thread rod 63 are caused to stop operating. Meanwhile, the first electromagnetic thread rod 43 also stops operating, causing the movable leaf 41 to return to its normal position as shown in FIG. 5, and the strap 60 can be continuously sent into the strap storage 52. When the strap storage 52 is fully occupied with the strap 60, the strap-storing motor in the strap-storing power unit 51 stops. At this point, a strap-feeding motor (not shown) is actuated to drive the strap-feeding unit 20 to feed the strap 60 direct into the strap rail 55. And, the automatic strapping machine 50 is now ready for work. It can be found from the above description that the strap feeding in an automatic strapping machine with the strap-feeding mechanism of the present invention needs not to open any door covering the machine 50. That is, the strap 60 can be quickly fed in an automated manner. And, the strap 60 which is pulled backward during an automatic strapping can smoothly enter the strap storage 52 via the opening 33 formed on the left side of the strap guiding channel 31.

As shown in FIGS. 3 and 4, the vertical shaft 42 fixedly supporting the movable leaf 41 is connected to a spindle 45 of the first electromagnetic thread rod 43 via a coupling 44, so that the shaft 42 moves with the spindle 45. When the first electromagnetic thread rod 43 is energized, the spindle 45 shall rotate by a predetermined angle. In the present invention, this angle is set to 45 degrees. When the first electromagnetic thread rod 43 is deenergized, the spindle 45 is returned to its original position by a return spring (not shown).

The cover panel 40 may be fixedly locked to the stationary panel 30. However, to facilitate a troubleshooting during an operation of the automatic strapping, the cover panel 40 is preferably connected at a right side to the stationary panel 30 by means of hinges 46, so that the cover panel 40 can be pivotally swung open relative to the stationary panel 30. A magnet 34 is provided at a top left corner of the stationary panel 30 so that the cover panel 40 can be magnetically attracted to the stationary panel 30 and closes the front of the stationary panel 30. A pull ring 47 can be provided to the cover panel 40 so that the cover panel 40 can be conveniently pulled open from the stationary panel 30. A length of stopping wall 35 extends leftward from a top beginning of the opening 33 at the left side of the vertical straight middle section of the guiding channel 31, so that the strap 60 can be smoothly guided into the strap storage 52 along the stopping wall 35.

The operation for strap-feeding in the automatic strapping machine with the present invention can be proceeded simply by pressing a pushbutton switch to actuate the first electromagnetic thread rod 43, so that the movable leaf 41 on the cover panel 40 is turned 45 degrees to form a left side wall of the strap guiding channel 31 on the stationary panel 30. And, causing rollers in the strap-storing power unit 51 and the strap-feeding unit 20 to rotate at the same speed shall quickly feed the strap 60 into the strap rail 55 above the automatic strapping machine 50 so that the machine 50 is ready for use. With the above arrangements, the present invention provides simple, easy, and quick strap feeding for an automatic strapping machine. And, when the strap 60 unexpectedly slides off the strap rail 55 and the strap-feeding unit 20 while the strap 60 is pulled backward during a strapping operation, the strap 60 can be automatically refed into the strap rail 55 for a next strapping. This largely improves the strap feeding in an automatic strapping machine.

What is claimed is:

1. A strap-feeding mechanism for an automatic strapping machine, comprising a quick strap-feeding mechanism for quickly feeding a beginning of a strap into a strap rail on said automatic strapping machine and an automatic strap-refeeding mechanism for clamping a strap which slides off said strap rail during a pull-back operation, so that said strap is prevented from sliding backward any further and is automatically refed into said strap rail again.

2. A strap-feeding mechanism for an automatic strapping machine as claimed in claim 1, wherein said quick strap-feeding mechanism comprises a stationary panel and a cover panel; said stationary panel being provided with a strap guiding channel, a lower end of said strap guiding channel being connected to an strap inlet of said automatic strapping machine and an upper end of said strap guiding channel being connected to an strap inlet of a strap-feeding unit of said machine, said strap guiding channel having a vertical straight middle section which has only one side wall and forms a vertical opening at another side facing a strap storage in said strapping machine; said cover panel being assembled to a front of said stationary panel and being provided with a vertically extended leaf, said leaf being driven by a first electromagnetic thread rod to turn 45 degrees from a normal position into a working position, a front edge of said leaf in said normal position being flush with said cover panel, said front edge of said leaf in said working position projecting into said stationary panel to close said vertical opening and forming another side wall of said strap guiding channel.

3. A strap-feeding mechanism for an automatic strapping machine as claimed in claim 1, wherein said automatic strap-refeeding mechanism comprises a driving wheel provided at a left side of the top end of said strap guiding channel, a rotational wheel provided at a right side of the top end of said strap guiding channel opposite to said driving wheel, a press plate provided on a movable seat of said strap-feeding unit at an end opposite to said strap inlet of said strap-feeding unit, and a microswitch provided below said press plate; said driving wheel being driven by a small motor to rotate and having a part extending into said strap guiding channel via a cut on said guiding channel, said rotational wheel being pivotally connected to a free end of an arm member which can be driven by a second electromagnetic thread rod to bring said rotational wheel to turn at the same time, said rotational wheel also having a part extending into said strap guiding channel via another cut on said strap guiding channel to contact with and press against said driving wheel, said press plate being in an ascendent position without touching said microswitch when said strap passes below said movable seat of said strap-feeding unit, and said press plate being in a descendent position when said strap slides off said strap-feeding unit and touching said microswitch to immediately actuates said second electromagnetic thread rod to rotate said arm member and said rotational wheel, whereby said rotational wheel together with said driving wheel clamp said strap in said strap guiding channel to prevent said strap from sliding backward any further, and said strap clamped by said driving wheel and said rotational wheel is refed into said strap rail by starting said small motor to rotate said driving wheel and by actuating said strap-feeding unit again.

* * * * *